US008242968B2

(12) United States Patent
Conrad et al.

(10) Patent No.: US 8,242,968 B2
(45) Date of Patent: Aug. 14, 2012

(54) MOBILE TELEVISION ANTENNA WITH INTEGRATED UHF DIGITAL BOOSTER

(75) Inventors: Timothy John Conrad, Mount Pleasant, IA (US); Gail Edwin McCollum, Wapello, IA (US)

(73) Assignee: Winegard Company, Burlington, IA (US)

( * ) Notice: Subject to any disclaimer, the term of this patent is extended or adjusted under 35 U.S.C. 154(b) by 402 days.

(21) Appl. No.: 12/560,147

(22) Filed: Sep. 15, 2009

(65) Prior Publication Data

US 2010/0117925 A1 May 13, 2010

Related U.S. Application Data

(63) Continuation-in-part of application No. 12/465,259, filed on May 13, 2009, now Pat. No. 8,018,394.

(60) Provisional application No. 61/113,765, filed on Nov. 12, 2008.

(51) Int. Cl.
*H01Q 1/12* (2006.01)

(52) U.S. Cl. ..... 343/878; 343/713; 343/815

(58) Field of Classification Search ..... 343/878, 343/713, 815, 817, 818, 833
See application file for complete search history.

(56) References Cited

U.S. PATENT DOCUMENTS

| | | | | |
|---|---|---|---|---|
| D209,969 | S | 1/1968 | Greenberg | |
| D210,025 | S | 1/1968 | Kleinberg et al. | |
| 3,790,950 | A | 2/1974 | Smith et al. | |
| 4,218,686 | A | 8/1980 | Blonder | |
| 5,262,793 | A | 11/1993 | Sherry | |
| 5,612,706 | A | 3/1997 | Podell | |
| D427,183 | S | 6/2000 | Chrisey et al. | |
| 6,154,180 | A | 11/2000 | Padrick | |
| 6,483,476 | B2 | 11/2002 | Cox | |
| D480,387 | S | 10/2003 | Burns | |
| 6,677,914 | B2 * | 1/2004 | Mertel | 343/815 |
| D500,496 | S | 1/2005 | Sherwood | |
| 7,068,234 | B2 | 6/2006 | Sievenpiper | |
| 7,180,462 | B2 | 2/2007 | Kaneko et al. | |
| D546,323 | S | 7/2007 | Van Buren et al. | |
| D551,662 | S | 9/2007 | Buren et al. | |
| 7,286,097 | B1 | 10/2007 | Van Buren et al. | |
| 7,358,909 | B2 | 4/2008 | Sherwood | |
| 7,423,606 | B2 | 9/2008 | Knadle, Jr. et al. | |
| 7,626,557 | B2 * | 12/2009 | Eckwielen et al. | 343/757 |
| 7,911,406 | B2 | 3/2011 | Eckwielen et al. | |
| 2007/0262912 | A1 | 11/2007 | Eckwielen et al. | |
| 2008/0117111 | A1 | 5/2008 | Ikeda et al. | |

* cited by examiner

*Primary Examiner* — Tan Ho
(74) *Attorney, Agent, or Firm* — Dorr, Carson & Birney, P.C.

(57) ABSTRACT

A mobile television antenna having an antenna element outwardly extending from opposing ends of a housing. An UHF digital booster extends perpendicularly from one side of the housing between the opposing ends carrying the antenna element. At least one UHF parasitic antenna element is connected on a boom which is integrally connected to the mobile television antenna housing. The ultra high frequency parasitic antenna element is held in a plane near the plane in which the antenna element is held by the housing.

17 Claims, 12 Drawing Sheets

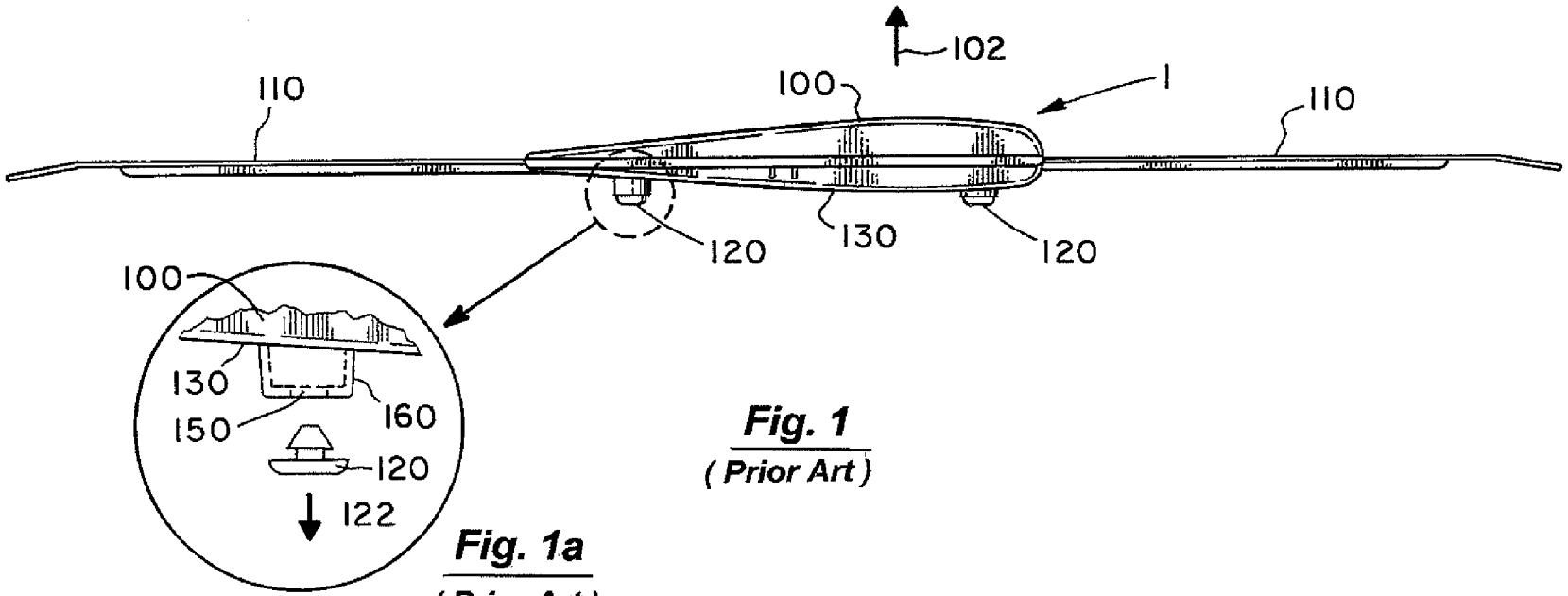
Fig. 1
(Prior Art)
Fig. 1a
(Prior Art)
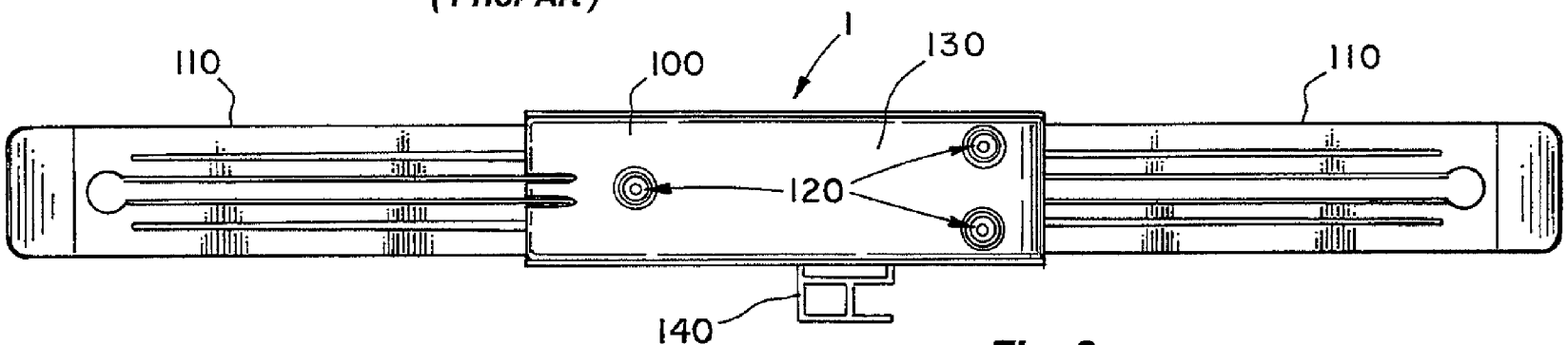
Fig. 2
(Prior Art)

MOBILE TELEVISION ANTENNA WITH INTEGRATED UHF DIGITAL BOOSTER

RELATED APPLICATIONS

This application is a continuation-in-part of U.S. patent application Ser. No. 12/465,259 filed May 13, 2009 which claims the benefit of U.S. Provisional Patent Application Ser. No. 61/113,765 filed Nov. 12, 2008.

This application is filed concurrently with "Television Antenna" U.S. Design patent application Ser. No. 29/343,567 filed Sep. 15, 2009.

BACKGROUND OF THE INVENTION

1. Field of the Invention

The present invention relates to aerodynamic very high frequency/ultra high frequency (VHF/UHF) television antennas and, in particular, to such antennas having UHF parasitic elements to boost reception of high definition television broadcast signals.

2. Discussion of the Background

Conventional mobile VHF/UHF television antennas exist for use on vehicles such as recreational vehicles (RVs) and for residential use.

The popular SENSAR television antenna, manufactured by Winegard Co., provides VHF/UHF television reception when the RV is parked. In use, the SENSAR mobile television antenna which is mounted on the roof is raised, rotated and pointed to a desired TV station by an operator inside the parked RV to target incoming television signals. When not in use, as when the RV is travelling, the SENSAR antenna is stowed on the roof, is aerodynamic, and is stabilized against the roof to minimize vibration. Variations of the SENSAR antenna are shown in U.S. Pat. Nos. D500,496 S; 5,262,793 and 7,358,909.

High Definition Television (HDTV) signals are principally broadcast in the high VHF and UHF bands with some changes. The high VHF band remains at 174 to 216 MHz. The UHF band has changed to 470 to 698 MHz which is narrower than before. Most HDTV channels are carried in the UHF band.

A need exists to improve UHF/VHF television reception by adding integral UHF parasitic antenna elements to boost HDTV UHF reception for use on roofs of vehicles or in residences.

SUMMARY OF THE INVENTION

A mobile television antenna having an antenna element outwardly extending from opposing ends of a housing. An UHF digital booster extends perpendicularly from one side of the housing between the opposing ends carrying the antenna element.

At least one UHF parasitic antenna element is connected on a boom which is integrally connected to the mobile television antenna housing. The ultra high frequency parasitic antenna element is held in a plane near the plane in which the antenna element is held by the housing.

The summary set forth above does not limit the teachings of the invention especially as to variations and other embodiments of the invention as more fully set out the following description taken in connection with the accompanying drawings.

BRIEF DESCRIPTION OF THE DRAWINGS

FIGS. 1 and 1*a* are side elevation views of a PRIOR ART mobile television antenna.

FIG. 2 is a bottom elevation view of the PRIOR ART mobile television antenna of FIG. 1.

DETAILED DESCRIPTION OF THE INVENTION

Figure 3:
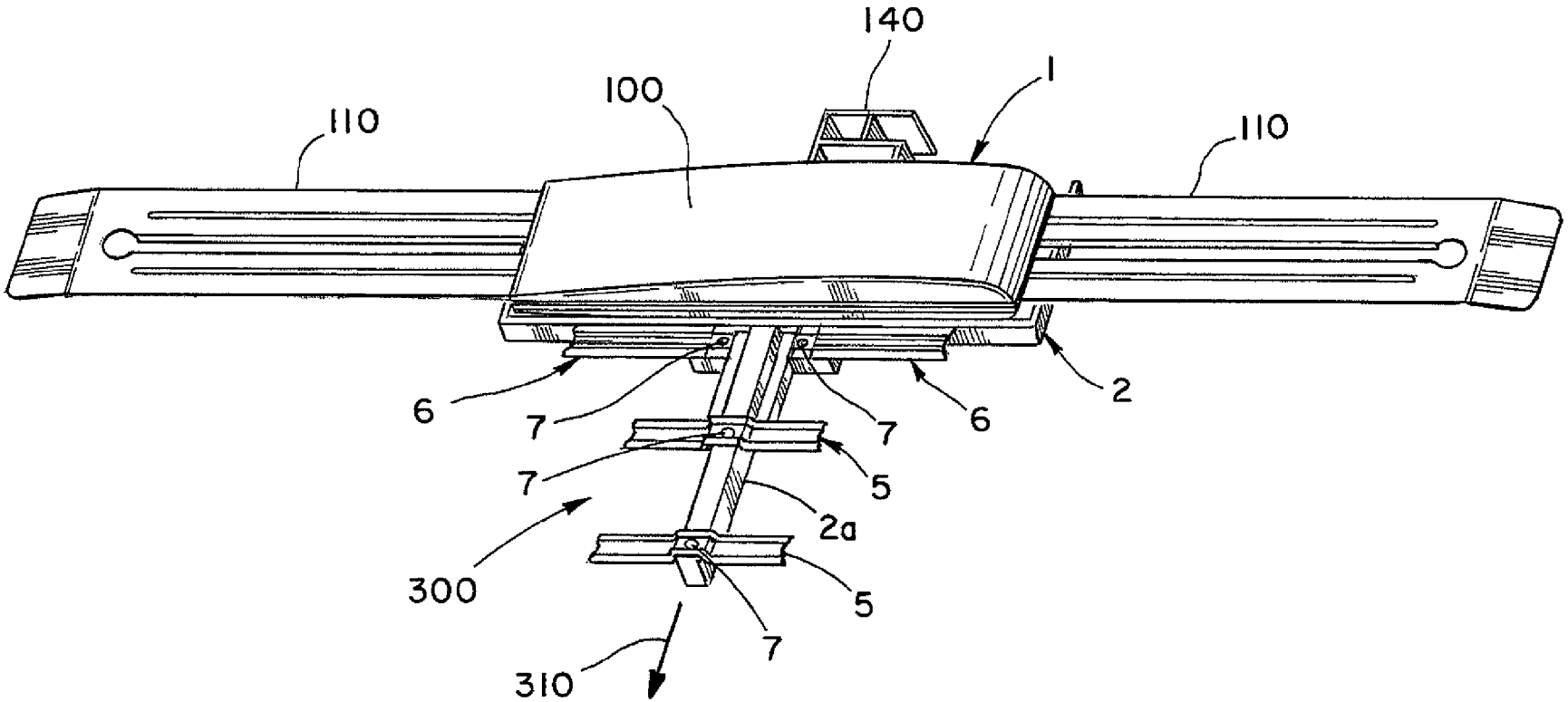
FIG. 3 is a perspective view of the mobile television antenna of FIGS. 1 and 2 retrofitted with the aftermarket UHF parasitic antenna of the invention.

In FIGS. 1 and 2, the prior art conventional SENSAR mobile television antenna 1 is shown to have a low profile, aerodynamic housing 100 with outwardly extending driven antenna elements 110. Three resilient base feet 120 such as "rubber" feet are inserted into the bottom 130 of the housing 1 and are used for stowing the mobile television antenna 1 on the roof of a vehicle such as a recreational vehicle. The term "rubber" is commonly used even though other materials such as neoprene are actually used. A block 140 connects the housing 100 to a support boom, not shown. U.S. Pat. No. 5,262,793, incorporated in its entirety herein by reference, discloses similar structure and different variations for the shape of the housing 100 and the number of resilient base feet 120 used for stowing the mobile television antenna 1 against the roof of a vehicle.

Figure 3A:
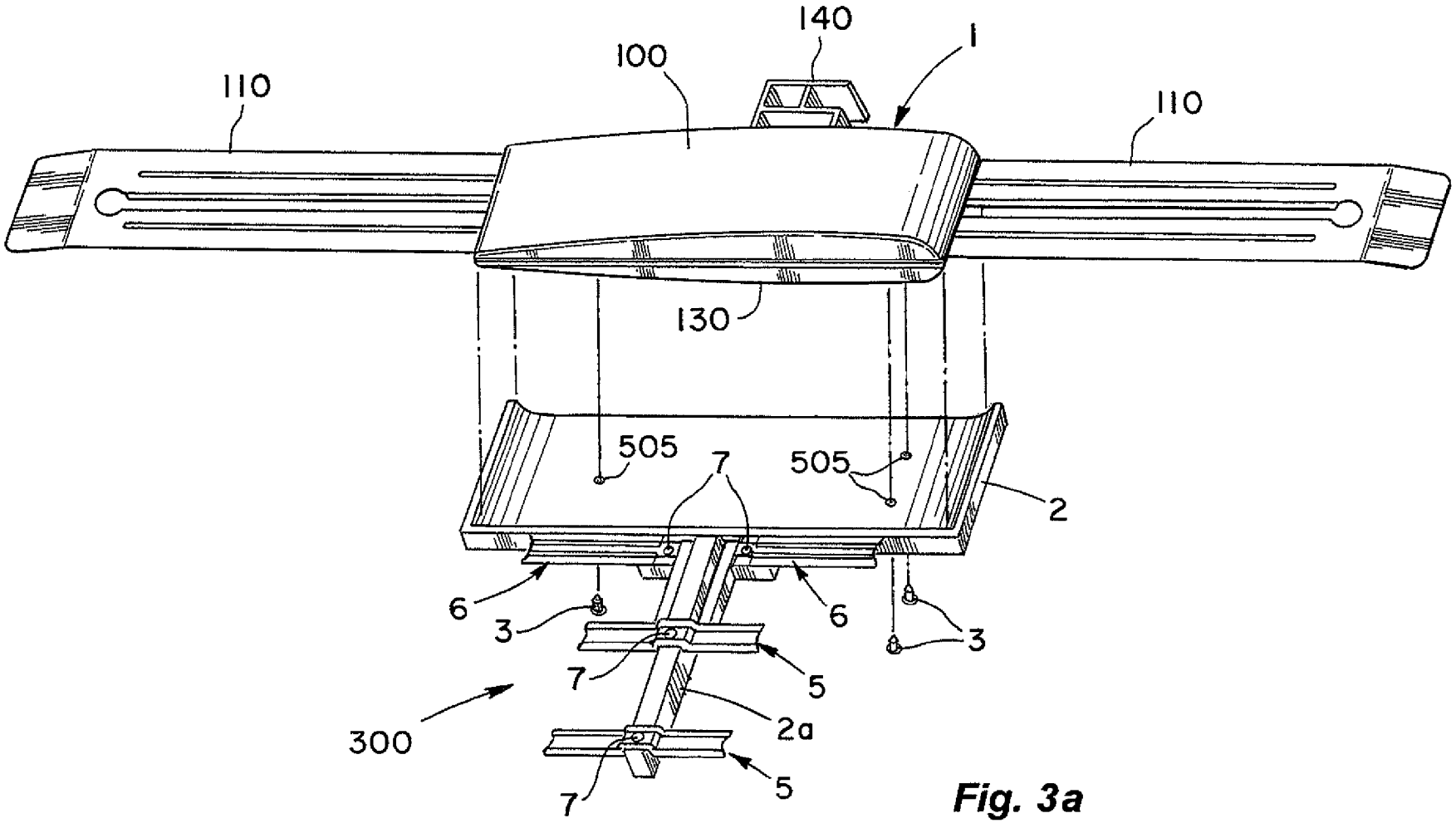
FIG. 3*a* is an exploded view of FIG. 3.
Figure 4:
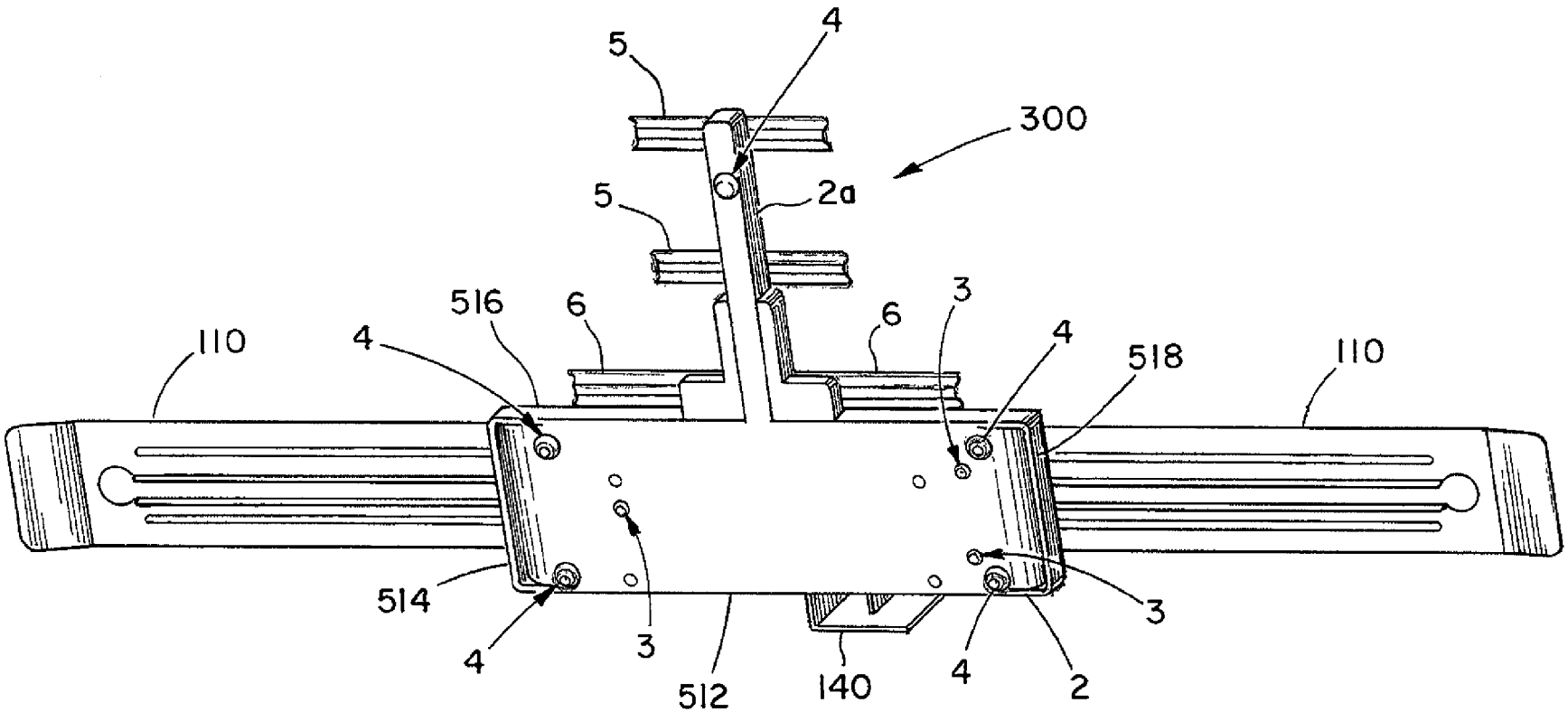
FIG. 4 is a bottom perspective view of the FIG. 3.

In FIGS. 3, 3*a* and 4, the aftermarket UHF parasitic antenna retrofit kit 300 of the invention is shown attached to the mobile television antenna 1. FIG. 3*a* is an exploded view of the attachment. The antenna retrofit kit 300 includes a molded plastic base 2 having an extending boom portion 2*a*, push rivets 3, resilient base feet 4, single UHF elements 5, double UHF elements 6 and rivets 7. As shown, base 2 is mounted to the bottom 130 of the mobile television antenna 1 with the UHF parasitic elements 5 and 6 on boom 2*a* pointing is a direction 310 away from block 140. The direction 310 with the antenna in use is towards the target broadcast television antenna or source of signal. The attached base 2 holds the UHF parasitic elements 5 and 6 as a director to increase UHF signal reception by the mobile antenna 1.

As shown in FIGS. 3 and 3*a*, two UHF parasitic elements 5 are attached to the boom 2*a* with two rivets 7 so that the UHF parasitic elements 5 are centered on the boom 2*a*. Two UHF parasitic elements 6 are attached to the boom 2*a* with two rivets 7. Any number of UHF parasitic elements 5 and 6 can be used to direct UHF signals to mobile antenna 1 in variations of the invention.

As shown in FIG. 4, five resilient base feet 4 are attached to the molded plastic base 2 (which includes the boom portion 2*a*). These five resilient base feet 4 substantially prevent damage to the vehicle roof and/or to the mobile television antenna 1 when the combined mobile television antenna 1 and retrofit kit 300 is stowed as discussed later.

Figure 14:
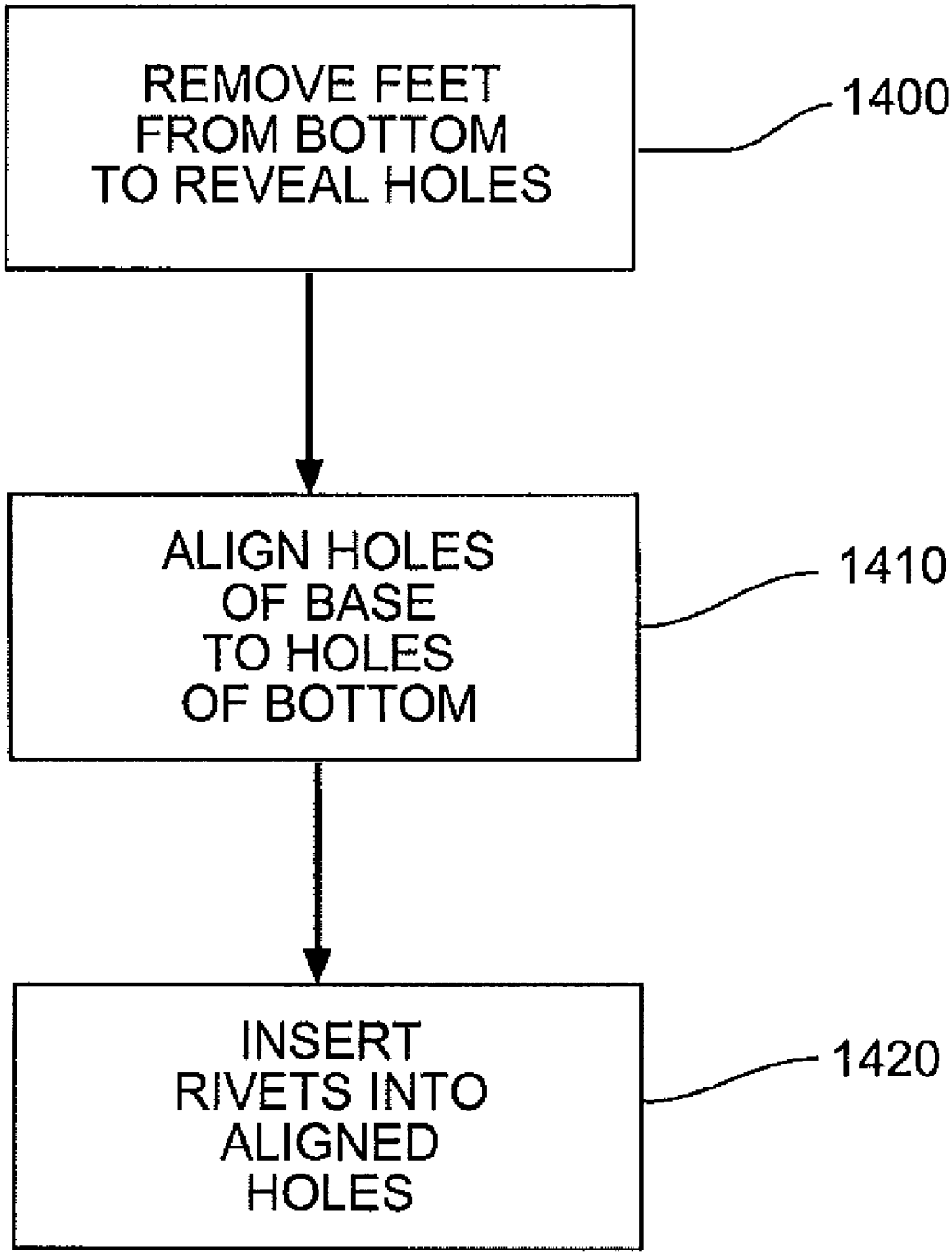
FIG. 14 sets forth a method of installing the universal aftermarket kit to the mobile television antenna.

The retrofit kit 300 is designed for ease of installation so that the operator can quickly and easily install the retrofit kit 300 to the existing mobile television antenna 1 on the roof of the vehicle without the use of tools or with minimal use of tools. The method for doing this shown in FIG. 14 occurs as follows. The mobile television antenna 1 is raised, as shown by arrow 102 in FIG. 1, to be off the roof of the vehicle. The existing resilient base feet 120 on the mobile television antenna 1 are removed in step 1400 to reveal foot holes 150 in the bottom 130 as shown in FIG. 1*a* by the operator pulling in the direction of arrow 122 with fingers or pliers. When each base foot 120 is removed, from the formed foot 160 of the bottom 130, a hole 150 is revealed. The bottom 130 may or may not have a formed foot 140. As shown is FIGS. 4 and 5, the base 2 is then placed up towards the bottom 130 of the mobile television antenna 1 with rivet holes 505 in the base 2 aligned with the revealed holes 150 in the bottom 130 as shown in step 1410. Three push rivets 3 (see FIGS. 9*a*, 9*b*, and 9*c*) are pushed-in by the operator through the rivet holes 505 of the base 2 to firmly hold the base 2 to the bottom 130 in foot holes 150 as shown in step 1420. The combined mobile television antenna 1 and the retrofit kit 300 is mounted and is ready for operation.

In summary, a method for retrofitting an UHF parasitic antenna 300 to operate with a mobile television antenna 1 has been set forth. The operator removes resilient base feet 120 from foot holes 150 in the bottom 130 of the mobile television antenna 1. The rivet holes 505 in the base 2 of the UHF parasitic antenna 300 are aligned over the revealed foot holes 150 in the bottom 130 of the mobile television antenna 1. The rivets 3 are inserted, by the operator pushing, into the aligned rivet and foot holes to attach the base 2 of the UHF parasitic antenna 300 to the mobile television antenna 1. The combined assembly is ready for operation.

In variations of the invention, use of common tools may be used such as pliers to assist in pulling out the feet 120. Or, in the case where the feet 120 are attached with screws through screw holes in the bottom, then a suitable tool can be used to remove the feet and the revealed screw hole used to receive the pushed in rivet. In another variation, the bottom 130 is conventionally mounted directly to the support used for raising and lowering the mobile antenna 1. In this variation, the antenna 1 is removed from the support and the base 2 with holes 505 formed and positioned to correspond to the connection between the bottom and the support permits the base 2 of the UHF parasitic antenna kit 300 to be held between the antenna 1 and the support. In all variations, base 2 of the parasitic antenna 300 is connected to existing holes in the bottom 130 of the mobile television antenna 1.

Figure 7:
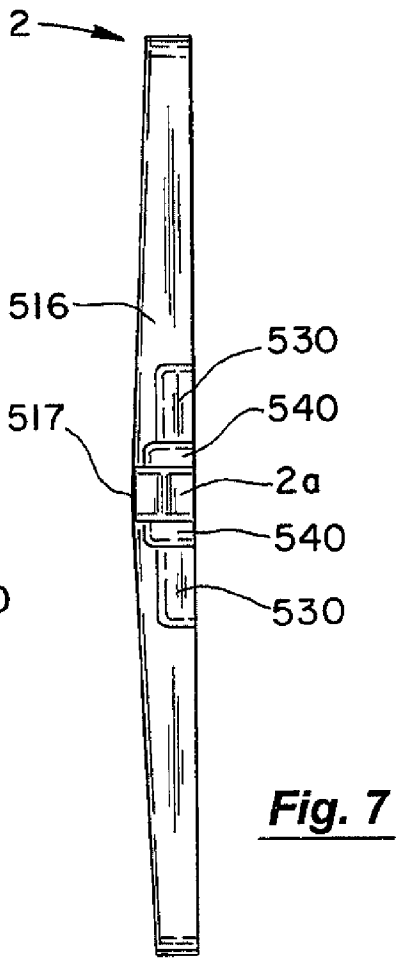
FIG. 7 is a view of the boom end of the base of the aftermarket UHF parasitic antenna of the invention.
Figure 5:
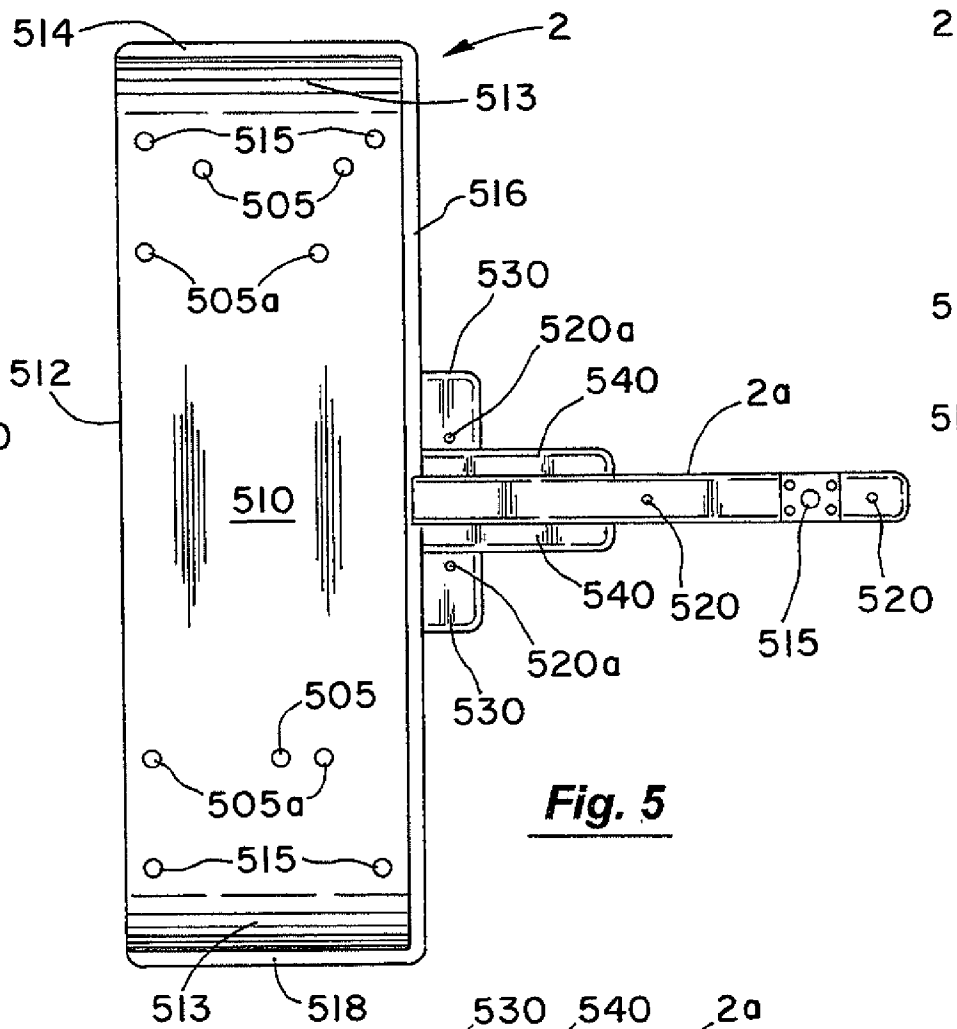
FIG. 5 is a top view of the base of the aftermarket UHF parasitic antenna of the invention.
Figure 8:
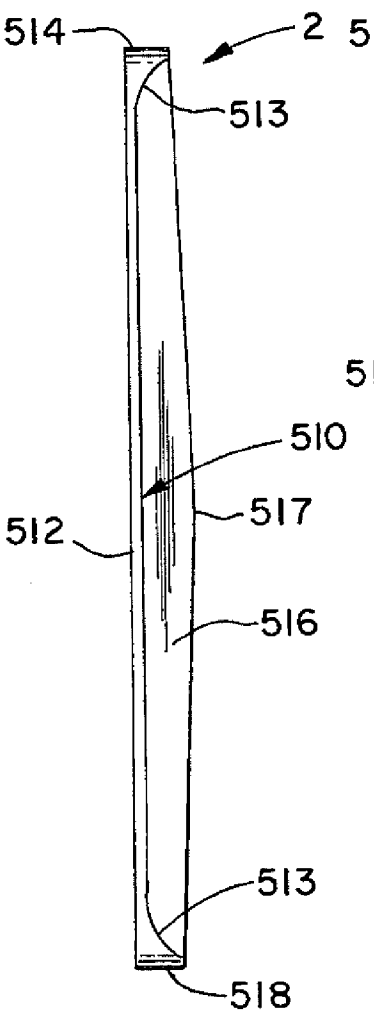
FIG. 8 is a view of the open end of the base of the aftermarket UHF parasitic antenna of the invention.

In FIGS. 5 through 8, the one-piece molded base 2 is shown with the extending boom portion 2*a*. In FIG. 5, three formed rivet holes 505 are shown that receive the three push rivets 3 as discussed above. Also shown are the five formed holes 515 which receive resilient base feet 4 as shown in FIG. 4. The base 2 has an engagement surface 510 which is open at end 512, curving 513 up into walls 514 and 518, and ending in wall 516. The top 517 of wall 516 slightly curves upward at the boom portion 2*a* as shown in FIGS. 7 and 8. The engagement surface 510 connects to the bottom 130 of the mobile television antenna 1 when the base 2 is attached with the push rivets 3. The three walls 514, 516, and 518 and the engagement surface 510 form a retention cavity for the housing 100 near the bottom 130. More or less than three walls can be used to form the retention cavity. The engagement surface 510 is configured and sized to generally mate with the bottom 130 of the mobile television antenna 1.

The pattern of three rivet holes 505 shown are sized and positioned in the engagement surface 510 to align with the pattern of three foot holes 150 in the bottom 130 of the mobile television antenna 1. The retrofit kit 300, however, is universal in that the kit can be retrofitted to more than one type of mobile satellite antenna 1 by providing more than one pattern of rivet holes 505 in the engagement surface 510. For example, FIG. 7 of the aforesaid U.S. Pat. No. 5,262,793 shows a pattern of four feet (and, thus four foot holes when the resilient feet are removed). As shown in FIG. 5, four rivet holes 505*a* correspond to the hole pattern of this type of antenna 1. FIG. 5 shows the engagement surface with two rivet hole patterns: one hole pattern is three rivet holes 505 corresponding to the mobile television antenna type/model having three bottom holes in the same pattern and one hole pattern is four rivet holes 505*a* corresponding to the mobile television type/model having four bottom holes in the same pattern. The engagement surface 510 can have a number of rivet hole patterns corresponding to a desired number of different types of mobile television antennas. The four rivet holes 505*a* are not shown in FIG. 3*a* for clarity purposes as the three rivet holes 505 are shown being aligned.

Figure 6:
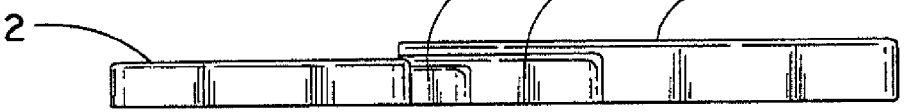
FIG. 6 is a side view of the base of the aftermarket UHF parasitic antenna of the invention.

The boom portion 2*a* extends outwardly as shown in FIGS. 5 through 7. Formed holes 520, 520*a* receive rivets 7 to firmly affix the UHF parasitic elements 5 and 6 perpendicular to the boom portion 2*a*. Each formed hole 515 receives a base foot 4. The boom portion 2*a* has a first structural support 530 on either side of the boom 2*a* for holding parasitic elements 6 and a second structural support 540 on either side of the boom for strengthening the boom. It is understood that different structural designs can be used for supports 530 and 540 and that the design and shape of the boom 2*a* can also vary under the teachings set forth herein. The boom 2*a* need not be integral and may be a separate structure connected to the base 2 in a variation.

Figure 9A:
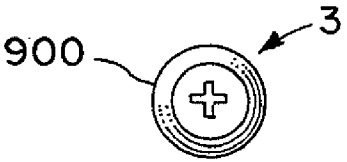
FIGS. 9*a*, 9*b*, and 9*c* are views of the push rivet.
Figure 9B:
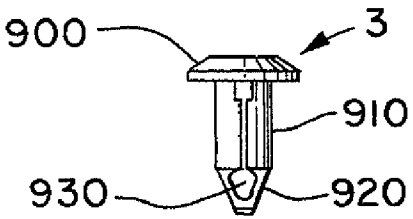
Figure 9C:
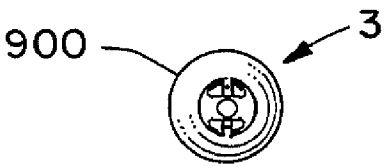

In FIGS. 9*a*, 9*b*, and 9*c*, the details of the push rivet 3 are set forth. Push rivets are conventional and available from different suppliers. The push rivet 3 has a head 900, a shank 910 and a pointed end 920. An internal cavity 930 exists to provide relief when pushed in.

Figure 10:
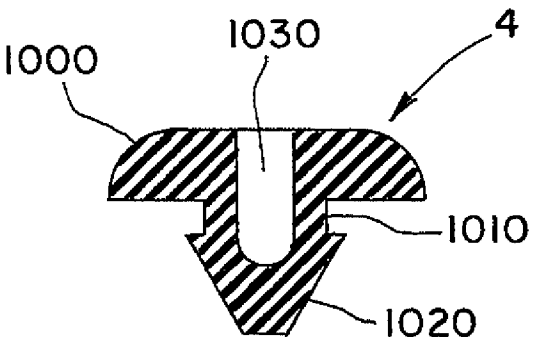
FIG. 10 is a view of the base resilient foot.

FIG. 10 is a cross-section of a conventionally available base foot 4 (also called a rubber foot) which is made of a resilient neoprene material. Base foot 4 has a foot 1000, a shank 1010, and a pointed end 1020. An internal cavity 1030 exists to provide relief when pushed in.

Figure 11B:
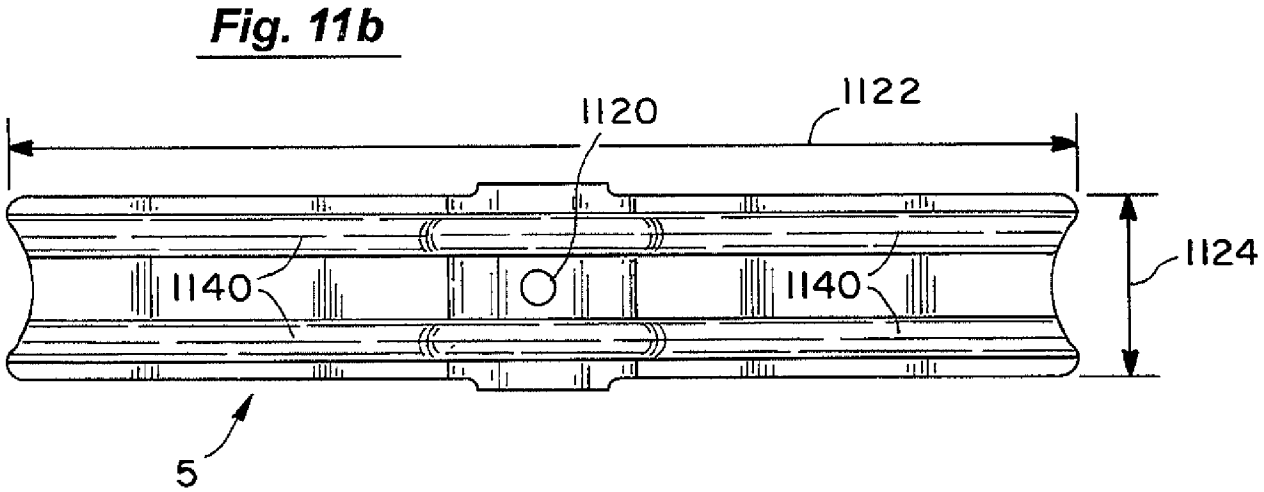
FIGS. 11*a*, 11*b*, and 11*c* are views of a single parasitic UHF antenna element.
Figure 11A:
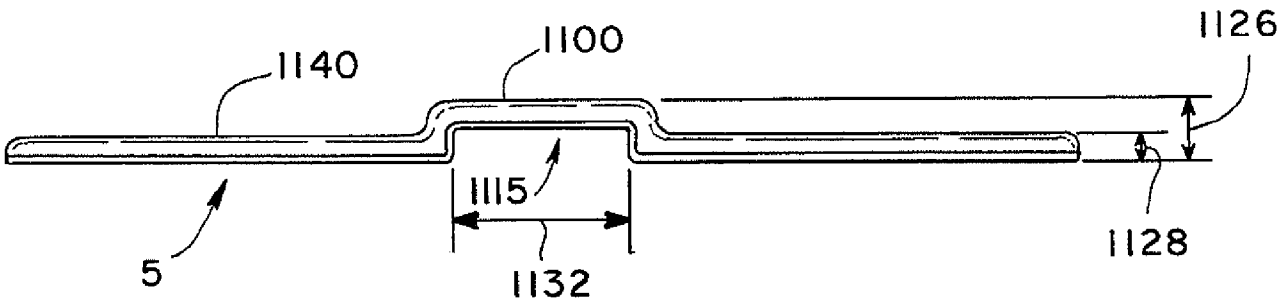
Figure 11C:
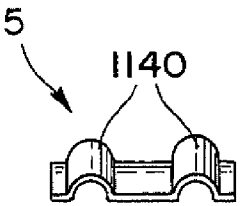

FIGS. 11*a*, 11*b*, and 11*c* show the details of the single UHF parasitic antenna elements 5 made from aluminum stock and coated with an iridite finish. The center portion 1100 is raised to form a cavity 1115 which mounts over the boom portion 2*a*. The formed hole 1120 on the center portion 1100 aligns over formed hole 520 in boom 2*a* so that a rivet 7 firmly secures the element 5 to the boom 2*a* through holes 1120 and 520. The shape of the element 5 can be of any suitable shape to act as a parasitic UHF antenna. The shape shown is aerodynamic and is provided with raised ridges 1140 that provide strength in wind and vibration. Dimensions for the embodiment shown are: length 1122 is 6.075 inches, length 1124 is 1.040 inches, length 1126 is 0.362 inches, length 1128 is 0.162 inches, and length 1132 is 1.000 inch.

Figure 12B:
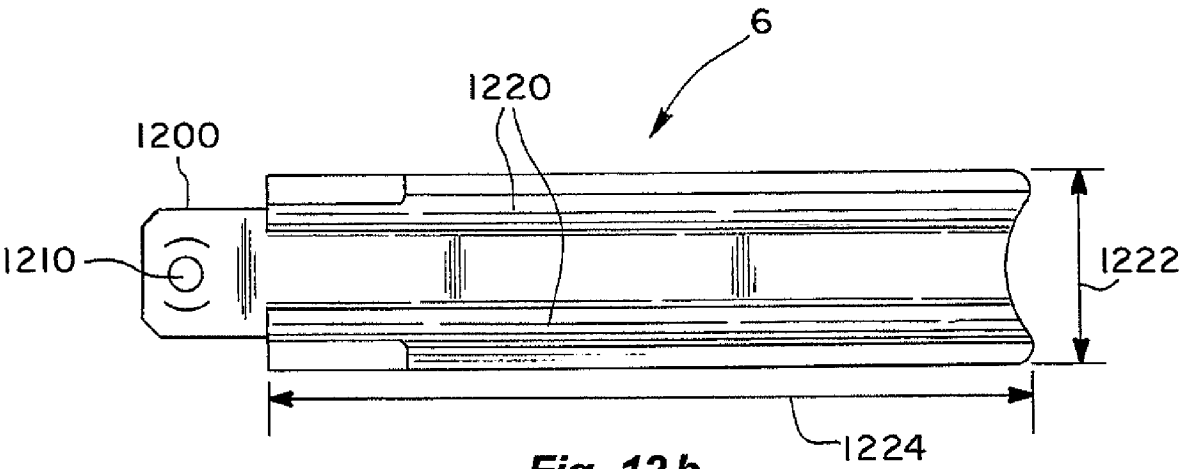
FIGS. 12*a*, 12*b*, and 12*c* are views of a double parasitic UHF antenna element.
Figure 12A:
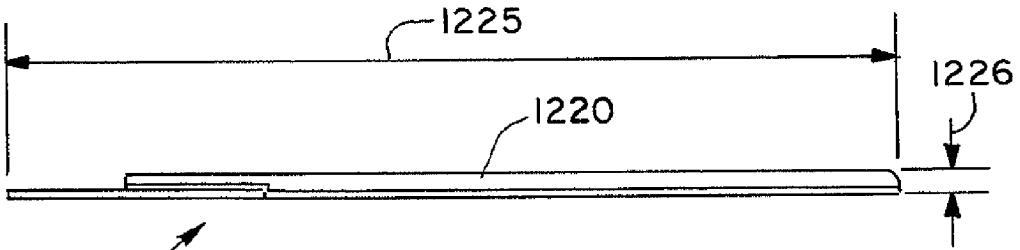
Figure 12C:
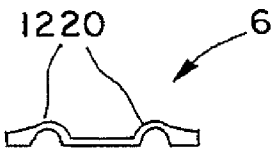

FIGS. 12*a*, 12*b*, and 12*c* show the detail of the UHF antenna elements 6 made from aluminum stock and coated with an iridite finish. The end portion 1200 has a formed hole 1210 which aligns over formed hole 520*a* in boom 2*a* on support 530 so that a rivet 7 firmly secures the element 6 to the boom 2*a* through holes 1210 and 520*a*. The shape of the antenna element 5 can be of any suitable shape to act as a parasitic UHF antenna. The shape shown is aerodynamic and is provided with raised ridges 1220 that provide strength in wind and vibration. Dimensions for the embodiment shown are: length 1222 is 1.08 inches, length 1224 is 5.30 inches, length 1225 is 6.00 inches, and length 1226 is 0.13 inches.

It is to be understood that any parasitic element design can be utilized herein such as wire or printed conductive material, etc. other than the metal stampings shown in FIGS. 11 and 12. The geometric shapes and lengths of each (or of one) parasitic element can vary depending on the frequency ranges involved especially in foreign countries. The spacings between the parasitic elements may also vary. In addition the single boom extension can be any suitable mechanical structure extending from antenna 1 to hold the parasitic elements 5 and 6. By way of example a mechanical support plane connected to or integral with base 2 extending outwardly could carry printed elements 5 and 6. Any suitable parasitic element design could be mounted on the boom 2*a* or could be mounted to the base 2.

Figure 13A:
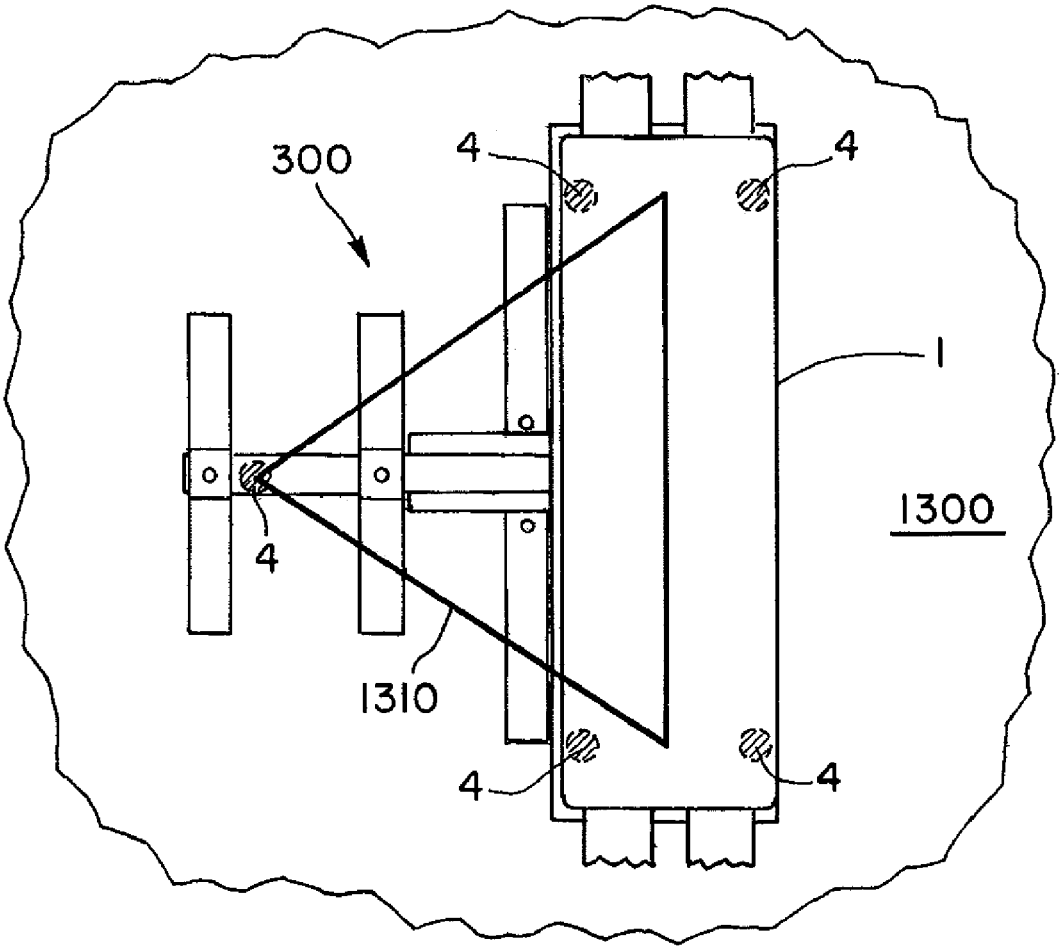
FIGS. 13*a* and 13*b* illustrate the stowing of the combined mobile television antenna and UHF parasitic antenna.
Figure 13B:
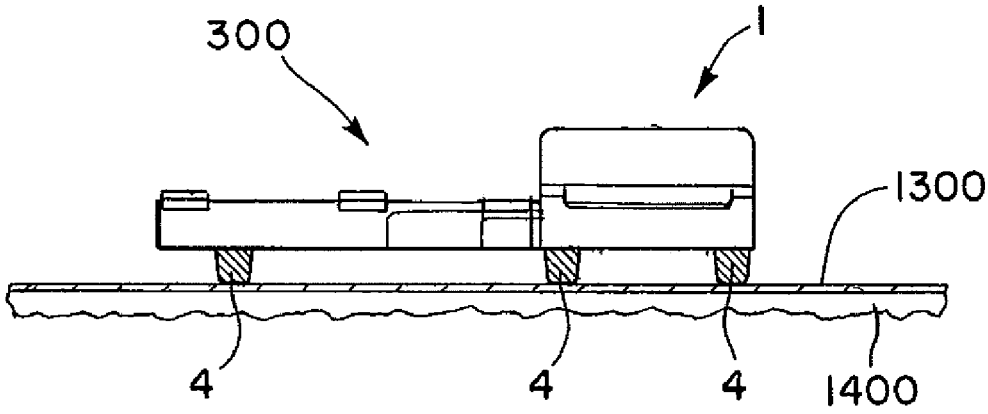

FIGS. 13*a* and 13*b* illustrate the stowing of the installed kit 300 and the mobile antenna 1 against the roof 1300 of a vehicle 1400. The five resilient feet 4 provide a triangular stow force 1310. The five feet 4 stabilize the combined mobile television antenna 1 with the installed kit 300 on the roof 1300 in high wind loads and against vehicle vibration during travelling. More or less than five feet 4 could be utilized. However, three feet 4 are required to provide the triangular stow force.

The aftermarket kit 300, shown in FIGS. 3 and 4, is provided to the operator with the parasitic elements 5 and 6 riveted to the boom 2*a* with all resilient feet 4 inserted. The user takes this assembly along with the separately provided push rivets 3 and then follows the aforesaid presented method of retrofitting as discussed above with respect to FIG. 14.

In summary, a universal aftermarket UHF parasitic antenna kit is set forth as an operational addition to more than one type of mobile television antenna. The aftermarket kit includes: a base having an engagement surface and an extending integral boom portion; a number of formed rivet holes in the engagement surface of the base that correspond in size and location to at least one pattern of a corresponding number of formed holes in the bottom of the mobile television antenna; push rivets that are pushed-in to engage the formed rivet holes and the formed bottom holes to firmly hold the base to the bottom of the mobile television antenna. The base has a number of formed base foot mounted resilient base feet for stowing stability and at least one extending UHF parasitic antenna element to boost performance of the mobile television antenna. The kit is universal in that any suitable number of hole patterns can be performed in the engagement surface 510 of the base 2 to correspond to the different types/models of mobile television antennas.

Figure 15:
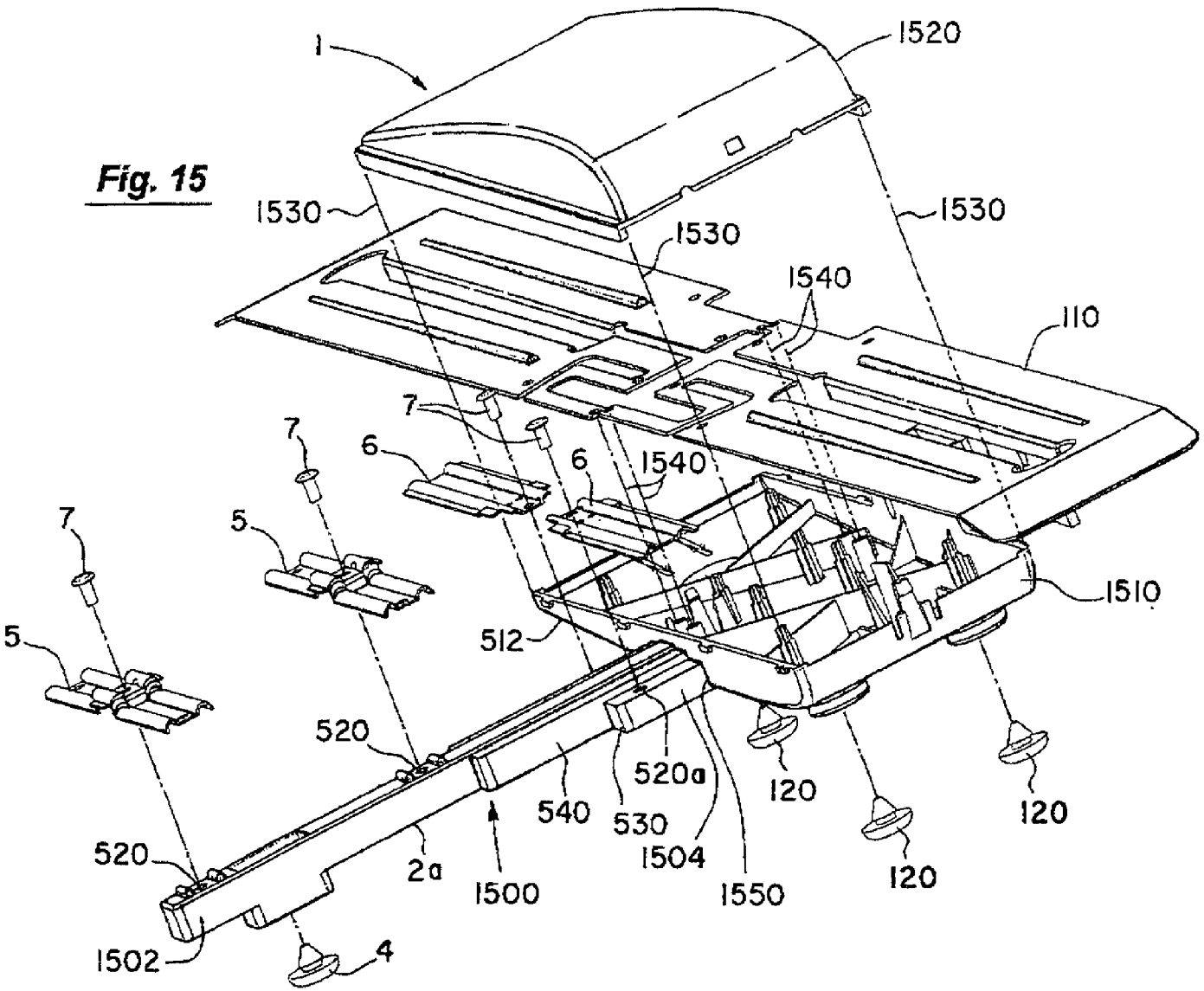
FIG. 15 is a perspective view of the mobile television antenna having an integrated UHF parasitic antenna of the invention.

FIG. 15 shows an embodiment of the invention with the UHF digital booster 1500 integrated into the conventional mobile television antenna 1. The booster 1500 has two ends 1502 and 1504. Where possible similar structure in this embodiment uses the same reference numerals as the antenna retrofit kit embodiment of FIGS. 1-14.

Figure 16:
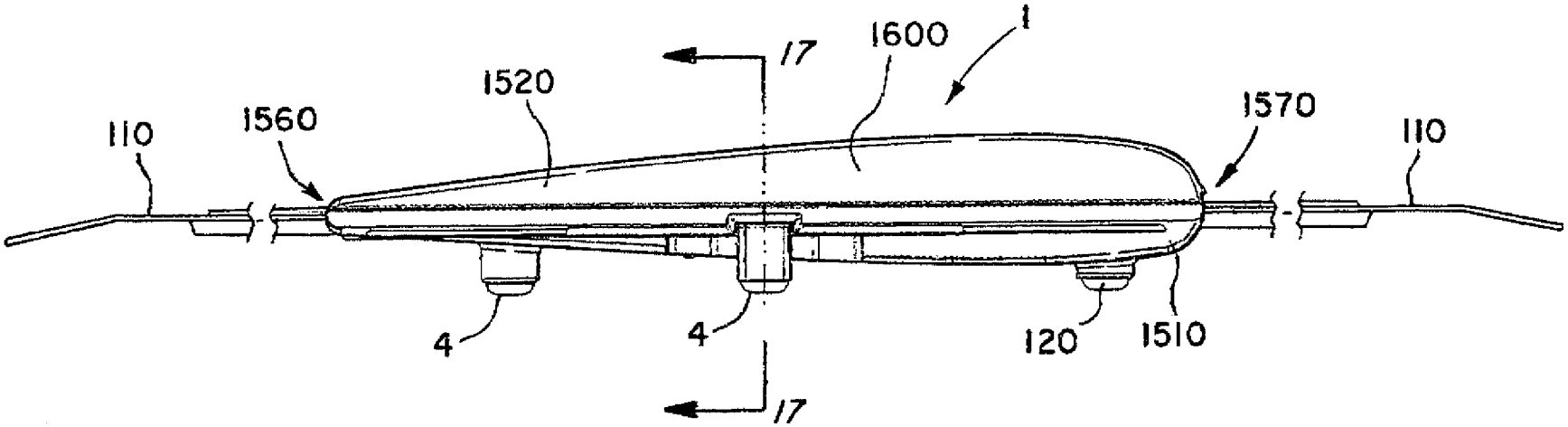
FIG. 16 is a side planar view of the mobile television antenna of FIG. 15.
Figure 17:
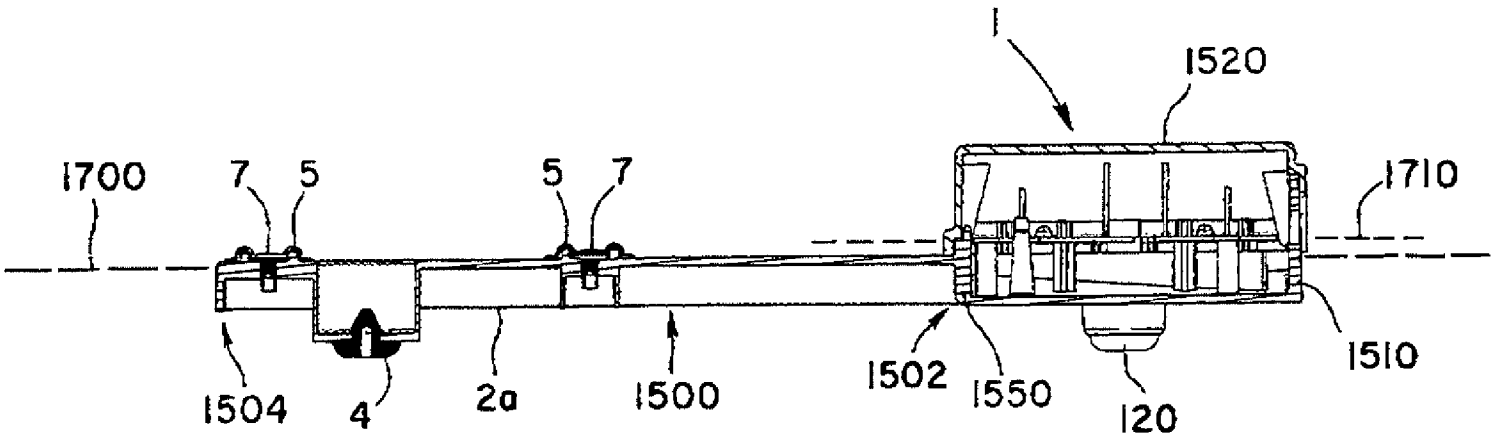
FIG. 17 is a section view 17-17 through FIG. 16.

The conventional mobile television antenna 1 has a housing 1600, a bottom half 1510, a top half 1520 and an antenna 110 as best shown in FIG. 16. As shown, the top half 1510 snap fits along lines 1530 into the bottom half 1510. The antenna 110 aligns over supports as shown by lines 1540. All of this is conventional. With respect to the construction of the mobile antenna 1, the embodiment shown in FIG. 15 is just an illustration. The construction of one conventional mobile antenna 1 is shown in greater detail in U.S. Pat. No. 5,262,793 and the use of such mobile antenna is shown in U.S. Pat. No. 7,358,909 which are both incorporated by reference herein.

As shown in FIG. 16, the mobile television antenna 1 has ends 1560 and 1570 with the antenna element 110 extending outwardly from these opposing ends 1560, 1570. In this embodiment the extending boom portion 2*a* is integrated into the center of side 1512 of the bottom half 1510 of the mobile antenna 1 as shown in FIG. 16. The extending boom portion 2*a* and the bottom half 1510 are formed from plastic material in a one piece mold.

The invention is shown in FIG. 15 to be the integral UHF digital booster 1500 extending, from the center of side 1512 of the mobile antenna 1 at integral connection 1550. The UHF digital booster 1500 has an extending boom portion 2*a* which is integrated (e.g., by one piece molded construction) to side 1512 and perpendicular to the antenna element 110 in a plane 1700 near the plane 1710 containing the antenna element 110. The planes 1700 and 1710 can correspond or be near to each other as shown. The term "near" as used herein is defined to include both "at" or "near".

The triangular stow force 1300 is present in this embodiment. Rather than having four base feet 4 in the base 2 (as the base 2 is not used in this embodiment), the three feet 120 show in FIGS. 1 and 2 in combination with booster foot 4 provide the triangular stow force 1300.

While the above is directed towards use of the UHF parasitic antenna for mobile television antennas for use on a vehicle such as an RV, such embodiments can also be used on such mobile television antennas when used in residential or home environments.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

We claim:

1. A mobile television antenna having a housing, an antenna element extending from opposing ends of said housing, and a plurality of resilient feet extending from a bottom of said housing for stowing the housing against a surface in combination with an ultra high frequency digital booster having:

a boom, said boom having one end integral with a center of one side of said housing between said opposing ends of said housing, said boom extending from said housing perpendicular to said antenna element;

a plurality of ultra high frequency parasitic antenna elements connected to said boom, said plurality of ultra high frequency parasitic antenna elements held by said boom in a plane near a plane in which said antenna element is held by said housing wherein each of said plurality of parasitic antenna elements has at least one raised rib providing structural strength;

a resilient boom foot on said boom, said resilient boom foot and said plurality of resilient feet forming a substantially triangular stabilization force between said surface and said combination of said mobile television antenna and said ultra high frequency digital booster when stowed.

2. The combination of claim 1 wherein said plurality of ultra high frequency antenna parasitic elements comprises three spaced ultra high frequency parasitic elements connected to said boom.

3. The combination of claim 1 wherein each of said at plurality of ultra frequency parasitic antenna elements has two raised ribs providing strength in wind and vibration.

4. The combination of claim 1 wherein said housing has a top half and a bottom half and wherein said one end of said boom is integral with said bottom half of said housing.

5. The combination of claim 4 wherein said boom and said bottom half of said housing are integrally formed as one piece from plastic material.

6. The combination of claim 4 wherein said bottom half of said housing has a plurality of resilient feet, said plurality of resilient feet stowing said mobile television antenna against a surface and wherein said boom further comprises a resilient boom foot located on an end of said boom opposing said one integral end, said resilient boom foot and said plurality of resilient feet forming a substantially triangular stabilization force between said surface and said combination of said mobile television antenna and said integral ultra high frequency digital booster.

7. The combination of claim 1 wherein said housing has a top half and a bottom half and wherein said one end of said boom is integral with said bottom half of said housing.

8. The combination of claim 7 wherein said boom and said bottom half of said housing are integrally formed as one piece from plastic material.

9. The combination of claim 7 wherein said bottom half of said housing has said plurality of resilient feet and wherein said boom further comprises a resilient boom foot located on an end of said boom opposing said one integral end, said resilient boom foot and said plurality of resilient feet forming said substantially triangular stabilization force.

10. A mobile digital television antenna comprising:

a housing, said housing having a top half and a bottom half, said housing top half connected to said housing bottom half;

a television antenna held between said connected housing top and bottom halves, said television antenna having opposing ends extending outwardly from said housing;

said housing bottom half having an integral boom portion, said integral boom portion extending outwardly on and perpendicular to a side of said bottom half of said housing, said boom portion located at a center of said side;

said integral boom portion of said bottom half of said housing having a plurality of ultra high frequency parasitic antenna elements connected perpendicularly to said integral boom portion to orient said plurality of ultra high frequency parasitic antenna elements in a plane near a plane in which said television antenna is held by said housing top and bottom halves, said plurality of ultra high frequency parasitic elements held parallel to said television antenna.

11. The mobile digital television antenna of claim 10 wherein said housing is formed from plastic material and wherein said boom portion and said bottom half of said housing are integrally formed as one piece from said plastic material.

12. The mobile digital television antenna of claim 10 wherein said plurality of ultra high frequency parasitic antenna elements comprise three spaced ultra high frequency elements connected to said boom portion.

13. The mobile digital television antenna of claim 10 wherein each of said plurality of ultra high frequency parasitic antenna elements has at least one raised rib.

14. The mobile digital television antenna of claim 10 wherein each of said plurality of ultra high frequency parasitic antenna elements is aluminum.

15. The mobile digital television antenna of claim 10 wherein said boom portion has at least one pair of structural supports on sides of said boom portion for strengthening said boom portion.

16. The mobile digital television antenna of claim 10 wherein said housing further comprises a plurality of feet on said bottom half of said housing.

17. The mobile digital television antenna of claim 16 wherein said plurality of feet provide substantial triangular stabilization when said mobile digital television antenna is stowed against a support surface.

* * * * *